US006199967B1

(12) United States Patent
Bayles et al.

(10) Patent No.: US 6,199,967 B1
(45) Date of Patent: Mar. 13, 2001

(54) DRAWER SLIDE AND DRAWER INCORPORATING QUICK-RELEASE CONNECTION

(75) Inventors: Peter Bayles, West Hunsbury; John Henry Whittlesea, Piddington, both of (GB)

(73) Assignee: Accuride International Limited, Northampton (GB)

( * ) Notice: Subject to any disclaimer, the term of this patent is extended or adjusted under 35 U.S.C. 154(b) by 0 days.

(21) Appl. No.: 09/348,962

(22) Filed: Jul. 7, 1999

(30) Foreign Application Priority Data

Jul. 7, 1998 (GB) ..... 9814730

(51) Int. Cl.[7] ..... A47B 88/00

(52) U.S. Cl. ..... 312/334.7; 312/334.8; 248/222.11; 248/222.13

(58) Field of Search ..... 248/222.11, 221.11, 248/222.13; 24/457, 458; 312/334.7, 334.11, 334.1, 334.4, 334.5, 334.17, 330.1, 333, 348.1, 350, 334.8, 348.2; 384/18, 21, 22

(56) References Cited

U.S. PATENT DOCUMENTS 1,963,220 * 6/1934 Anderson ..... 312/334.11
3,389,949 * 6/1968 Studinski et al. ..... 312/334.11
4,068,887 * 1/1978 Babbs .
4,557,531 * 12/1985 Rock et al. .
5,632,541 * 5/1997 Uthoff ..... 312/333
5,632,542 * 5/1997 Krivec ..... 312/334.7

FOREIGN PATENT DOCUMENTS

2030847 * 4/1980 (GB) ..... 312/350

* cited by examiner

*Primary Examiner*—Janet M. Wilkens
(74) *Attorney, Agent, or Firm*—Harter, Secrest & Emery LLP; Stephen B. Salai, Esq.; Brian B. Shaw, Esq.

(57) ABSTRACT

A drawer slide and drawer slide combination which incorporates a connecting clip for providing a quick-release connection between the drawer slide 3 and the drawer 21 the clip comprising a fixing part 1 for connection preferably with a snap-fit, and preferably to the slide and a latching part 13 having a projection 17 thereon, preferably for engagement with an aperture 19 in the drawer 21. The latching part 13 is preferably spring loaded and preferably pivotable between a first aperture engaging position for connecting the drawer to the slide and a second release position in which the projection 17 no longer engages in the aperture in the drawer, whereby the drawer and slide can be disconnected. Disconnection is achieved by applying finger pressure to a release latch portion 15, which may be integral with the latching part 13. The connecting clip could be made of spring metal, but is preferably made of resiliently deformable plastics material. It may be formed in one or in two parts.

13 Claims, 4 Drawing Sheets

DRAWER SLIDE AND DRAWER INCORPORATING QUICK-RELEASE CONNECTION

FIELD OF THE INVENTION

This invention relates to a drawer slide and drawer incorporating a quick-release connection between the drawer slide and the drawer.

Nowadays, office furniture and the like which incorporates one or more drawers normally has each drawer mounted within a frame by means of a drawer slide so as to reduce friction and hence, wear between the drawer and the frame. Drawer slides are well known and comprise at least two longitudinally extending members, slidable relative to one another, there usually being a plurality of ball bearings arranged between the two relatively slidable members. In the past, one of the relatively slidable members has been fixedly secured to the frame, whereas the other has been secured to the drawer. It is preferred, however, nowadays that instead of fixedly securing one of the members to the drawer, some form of releasable coupling is provided so that the drawer can simply be removed from the frame and furthermore, so that the drawers are easily assembled within the frame.

A quick-release connecting clip of the above type is known in which a deformed spring steel clip has one end connected by riveting to the slide, and the other, kinked end terminates in a step so as to provide a projecting nose engageable within an aperture in the side wall of the drawer. This aperture in the side wall is spaced somewhat rearwardly from the front of the side wall. This construction of connecting clip suffers from the disadvantage that it is made of spring steel and has to be pre-connected to the slide. Furthermore, because of the construction of the clip, it is possible for the clip to become disengaged from the aperture within the side wall of the drawer when, for example, the drawer is opened quickly and reaches the end of its travel. If the drawer is full of papers, it will be extremely heavy and substantial forces will be borne by the clip, which can cause the clip to deform and become disengaged from the drawer.

In another known arrangement, two clips are provided, one being located between the drawer front and front of the drawer slide to provide a vertical latch, and one between the top of the slide and the drawer to provide a fore and aft latch. Such a double clip arrangement has its obvious disadvantages.

The present invention seeks to provide an improved design of drawer slide and drawer, with a quick-release connection between the drawer slide and drawer, which is relatively simple to manufacture and fit, and is thus inexpensive.

SUMMARY OF THE INVENTION

According to the present invention, we provide a drawer slide and drawer combination incorporating a quick-release connection between the drawer slide and drawer, the combination comprising a drawer, at least one drawer slide comprising at least two slide members slidable relative to one another, an external one of said members being connectable to a framework and an inner one of said members being connectable to the drawer and a clip having a fixing part by means of which it may be connected to one of the inner slide member and the drawer, and a latching part having a projection thereon for engagement within an aperture or recess in the other of the inner slide member and the drawer, the latching part being moveable between a first position in which the projection engages with the aperture or recess to connect the drawer to the inner slide member and a second position in which it is disengaged from the aperture or recess to allow disconnection of the drawer from the inner slide member, there being means on or able to act on the latching part to enable the part to be moved between its first and second positions, and wherein the co-operation between the projection and the aperture or recess is such as to provide both vertical and fore-and-aft latching, and including further co-operating means on the drawer and drawer slide to hold the side of the drawer closely adjacent to the side of the slide.

In one construction, the clip is formed of two separate parts, one comprising the fixing part, and the other comprising the latching part, which may be spring loaded; in this construction, co-operating means are provided on each part to assist in holding them together in use, with the spring bias to the latching part being provided by a leaf spring portion on the fixing part, and the latching part being held in position, in use, by being sandwiched between the fixing part and the one of the inner slide member and the drawer to which the fixing part may be connected.

In another construction, the clip is a single moulded part which preferably incorporates a spring bias to the latching part provided by moulding the latter in a material which is resiliently deformable with a set, whereby when relaxed, it will take up its first position.

Preferably, there is a stop on the clip which prevents the latching part being moved through more than a few degrees when it is moved to its second position.

Preferably, the projection has thereon two chamfered surfaces arranged at right angles to one another. This assists in connecting the drawer to the slide by permitting fitting either from the front or from above.

Preferably, the slide is adapted to receive the fixing part of the connecting clip with a snap fit and the drawer has an aperture therein into which the projection on the latching part is spring biased to connect the drawer to the slide.

Preferably hook means is provided at a rear end of the slide which engages with a rear end of the drawer to prevent relative up and down movement between the drawer and slide at the rear of the drawer.

Preferably, the co-operating means comprise a projecting nose at the front end of the slide which engages within a recess, provided by a lancing or by an aperture, in the front of the drawer. In this way, the drawer is positively located alongside the slide, thus ensuring that twisting of the drawer relative to the slide is avoided. This means that any forces between interengaged drawer and slide which are accommodated by the connecting clip are shear forces. This allows the clip to be manufactured from plastics material which is relatively strong in shear. This also means the clips can be manufactured by a moulding process.

BRIEF DESCRIPTION OF THE DRAWING

Several embodiments of the present invention are now described by way of example with reference to the accompanying drawings wherein.

Figure 1:
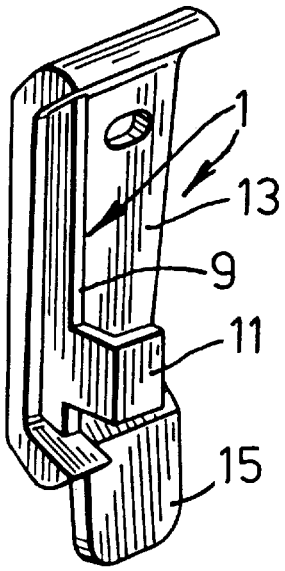
FIG. 1 is a perspective view of a one-piece connecting clip for location between a drawer and a drawer slide.
Figure 2:
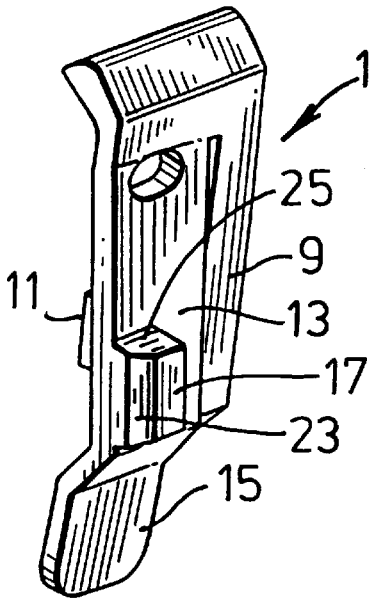
FIG. 2 is a perspective view of the clip of FIG. 1 from the opposite side.
Figure 8:
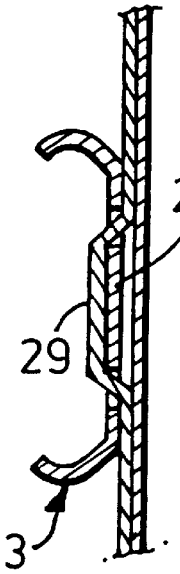
FIG. 8 is a section through the front of a drawer showing the lancing.

DETAILED DESCRIPTION OF A PREFERRED EMBODIMENT:

Referring to the drawings, the clip shown in FIGS. 1 and 2 is moulded from plastics material in one piece and has a fixing part 1 for location within an inner slide member 3 of a drawer slide S. The drawer slide 5 is of generally known construction with the inner slide member 3 being slidable relative to one or more further slide members, there being a plurality of ball bearings located between the respective members. An outer slide member (not shown) is connectable to a framework for the drawer. The inner slide member 3 has a generally C-shaped cross-section, as shown in FIG. 8 and the fixing part 1, as is apparent from the drawings, is shaped to form a snap-fit therein. However, it is not essential that it forms a snap-fit therein, and alternative methods of attaching the clip to the slide member 3 (or it the drawer) will be apparent to those skilled in the art. A strengthening rib 9 extends throughout a major part of the length of the fixing part 1 and projecting outwardly from the strengthening rib 9 is a stop 11. The clip also comprises a spring-loaded latching part 13 which is connected to the fixing part 1 at is upper end, the profile of its upper end matching that of the fixing part 1. The part 13 is longer than the part 1 and is moulded so as to have a permanent set which causes the part 13 to lie in a different plane from the part 1, the two planes making an angle of a few degrees with one another. At is lower end, the spring-loaded part 13 terminates in a release latch portion 15, whereby by pressing ones finger against said portion 15, the part 13 can be moved against the bias provided by its permanent set so as to move it into and beyond the plane of the fixing part 1, until it engages the stop 11. Projecting from the face of the spring-loaded part 13, opposite the face of the fixing part 1 from which the strengthening rib and stop 11 project, is a projection 17 for engagement within an aperture 19 in the side wall of a drawer 21. The projection 17 has a first chamfer 23 on its front edge and a second chamfer 25 on its top edge. These allow the projection 17 easily to enter the aperture 19 when the drawer is offered up onto the slide either from above or from the front thereof The permanent set or spring bias of the spring-loaded part 13 is such that when the drawer 21 and the drawer slide 5 are assembled together, the projection 17 will automatically be biased into snug engagement within the aperture 19. The side face of the projection opposite the chamfer 23, and its lower face, are square latching faces.

Figure 6:
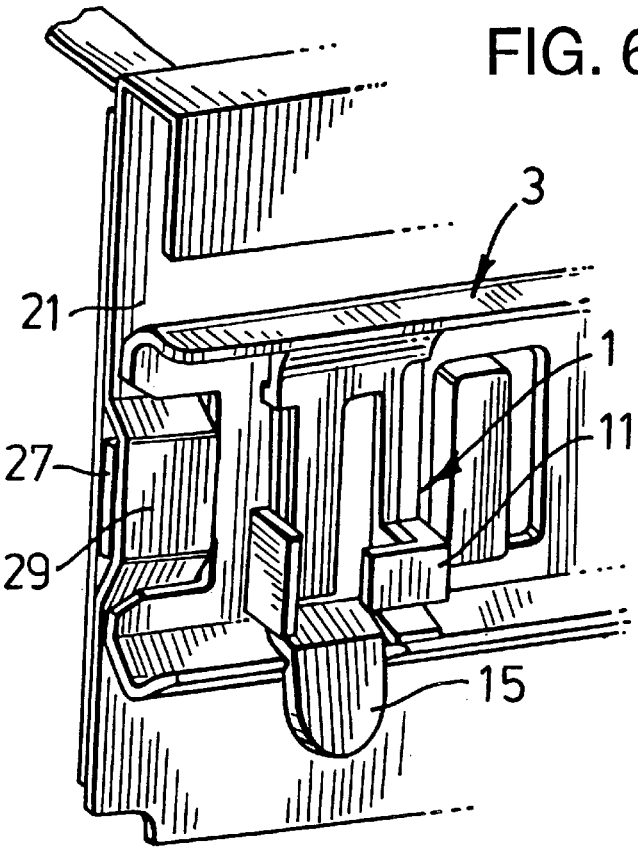
FIG. 6 is a perspective view showing the clip of FIGS. 1 and 2 located in position on a drawer slide.
Figure 7:
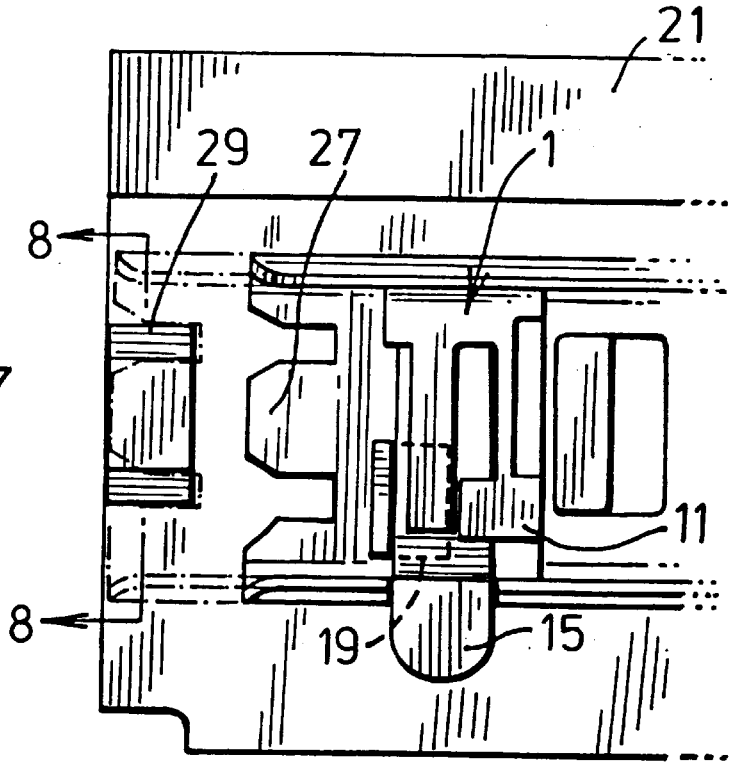
FIG. 7 is a side elevation of the front of a drawer slide showing a clip in position and a nose for engagement with a lancing on the front of a drawer.

As can be seen from FIGS. 6–8, when the drawer 21 and drawer slide 5 are assembled together, they are held in close side-by-side relationship by virtue of a nose or tongue 27 on the front end of the drawer slide 5 engaging in an aperture provided by a lancing 29 in the front of the drawer.

Figure 3:
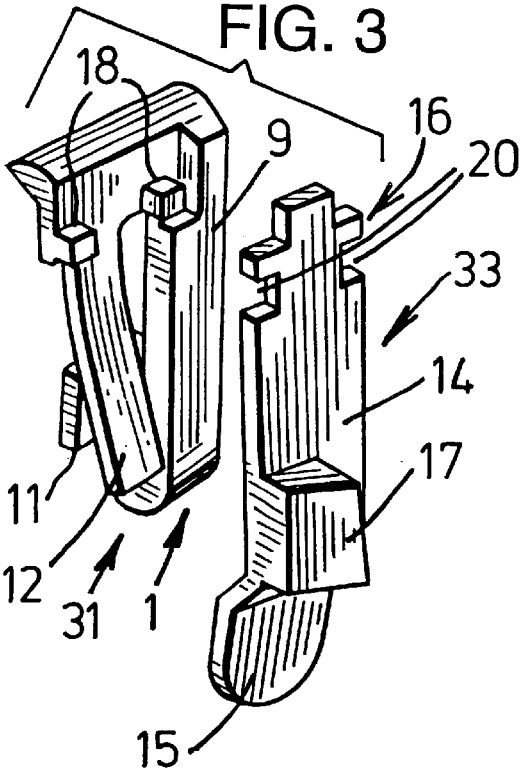
FIG. 3 is a perspective view of a two-piece clip.
Figure 4:
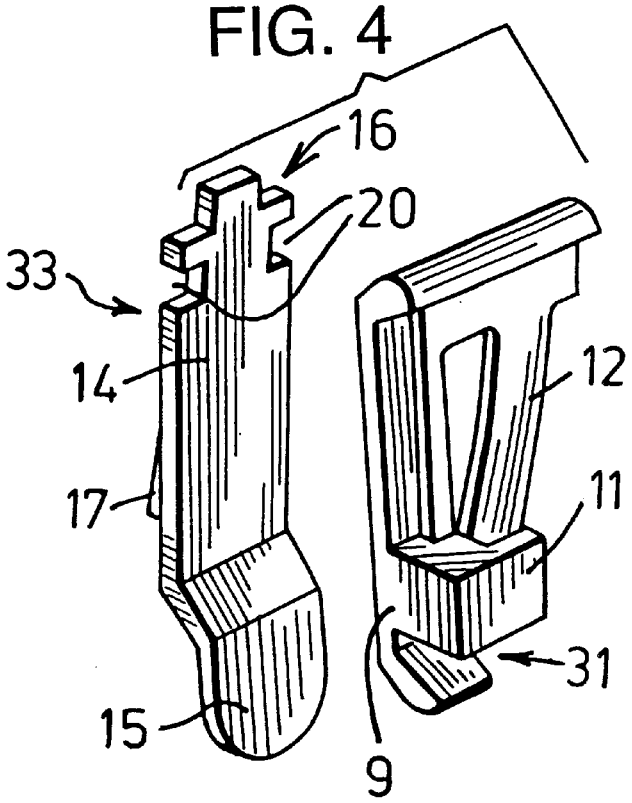
FIG. 4 is a perspective view of the clip of FIG. 3 from the opposite side.
Figure 5:
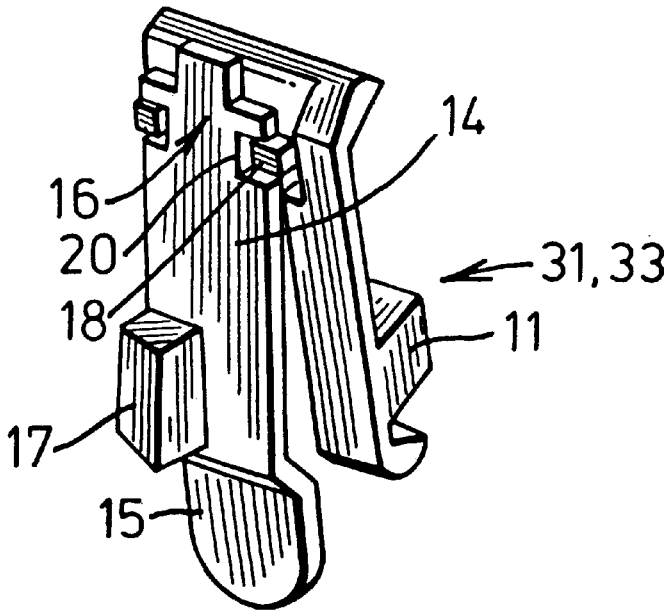
FIG. 5 is a perspective view showing the clip of FIGS. 3 and 4 assembled together.

Referring now to FIGS. 3–5, the two-piece connecting clip, when assembled and in use is very similar in construction to the one-piece clip of FIGS. 1 and 2. The two-piece clip is formed from two moulded parts 31, 33. The part 31 incorporates a fixing part 1 identical to that of the one-part version which incorporates a strengthening rib 9 and a stop 11. However, instead of a spring-loaded part 13, it is provided with a biasing arm 12, which cooperates with the second part 33. The second part 33 has a latching arm 14 which is generally of a similar shape to the spring-loaded part 13 of the one-piece construction and which has an identical release-latch portion 15 and projection 17 incorporated thereon. At its upper end, the aim 14 has a generally cruciform portion 16, by means of which the part 33 can be connected to the part 31. To enable the two parts to be held together, the part 31 has two projecting lugs 18 thereon which engage within the recesses 20 formed between the cruciform portion 16 and top of the arm 14. As can be seen from FIG. 5, when the two parts 31 and 33 are assembled, the biasing arm 12 on the first part 31 will be located behind the arm 14 on the part 33 and because the biasing arm 12 has a permanent set, as is the case with the springloaded part 13 in the one-piece construction, the arm 14 will take up a similar position relative to the fixing part 1 in the two-piece construction, as is the case in the one-piece construction. The two-piece construction of connecting clip is assembled into the slide member 3 of the drawer slide 5 in the same manner as the one-piece construction and once assembled, the two parts are held together.

To assemble a drawer with the drawer slide and connect the two together, the one or two-piece connecting clip is first of all located within the slide member 3 of the drawer slide with its spring-loaded latching part 13 or latching arm 14 abutting the flat inside face of the slide member 3 and the projection 17 extending through an aperture or slot (not shown) therein. In practice, there will, of course, be two drawer slides, one for each side of the drawer with the respective slide members 3 facing one another and each will be provided with a connecting clip having its projection 17 extending outwardly through the aperture in the slide member 3 so as to project beyond the outside face of the slide. A drawer 21 is then placed over the two drawer slides and its rear end is slid back over the drawer slides until a rear end thereof comes into engagement with a hook on the rear of the slide. This hook engages in a recess provided for the purpose in the rear of the drawer so as to provide a vertical location for the rear of the drawer. The drawer can be connected to the drawer slide by a simple snap-fit, either by pushing the drawer downwards relative to the drawer slide, if it is slightly raised, or alternatively, by pushing it rearwards if it is perfectly in line. The presence of the drawer alongside the drawer slide will cause pressure to be applied to the projection 17 on each connecting clip, thus moving either the release latch portion 15 in the case of the one-part construction, or the arm 14 in the case of the two-part construction, against its spring bias until the aperture in the side wall of the drawer is aligned with the projection 17 on the clip, whereupon the spring bias within the spring-loaded part 13 or biasing arm 12 will cause the projection 17 to snap into the aperture in the respective side wall of the drawer 21. The drawer 21 and drawer slides 5 are then interconnected. Before this interconnection can occur, it is necessary for the nose or tongue 27 on the front edge of the drawer slide 3 to engage within its respective aperture, provided by the lancing 29 on each side edge of the drawer 21. Once so engaged, the front end of each drawer slide is held closely alongside the side walls of the drawer 21. This is important, because when the drawer is opened and is full, and the drawer slide reaches the forward most part of its extension capability, the momentum of a full drawer has to be absorbed almost completely by the connecting clips. If the slide member 3 of each drawer slide is held closely adjacent its respective drawer side wall, there is virtually no twisting of drawer relative to slide member 3 and this means that the forces acting on the connecting clips due to the momentum of a full drawer are taken almost completely as shear forces in the spring-loaded part 13 in the case of the one-piece clip, or arm 14, in the case of the two-piece clip. This means that the connecting clips can be moulded from plastics material which is strong in shear, but not in twisting.

The above-described constructions of-quick-release drawer systems have the quickrelease connecting clips at the very front of the drawer and the drawer slides. This means that when it is desired to disconnect a drawer from its drawer slide, this is a very simple operation by the user applying finger pressure to the release latch portion 15 on the lower end of the spring-loaded part 13 (in the case of the one-piece clip) or the arm 14 (in the case of the two-piece clip). This will move the respective part 13 or 14 against its spring bias, thus moving the projection 17 out of the aperture. in the side wall of the drawer and allowing the drawer to be removed not only from its slide but also from the framework in which the whole mechanism is located. It should be appreciated, however, that it would be possible to locate the connecting clips further towards the rear of the drawers or even at the rear of the drawers. A further advantage, however, of having the clips at the front of the drawers is that they are easily accessible without having fully to open the drawers.

It is an important feature of the present invention that the latching faces on the projection 17 and on the aperture 19 within the side walls of the drawer extend generally at right angles to the side walls of the drawer. This means that when a drawer is opened or closed and suddenly stopped, the forces between the drawer and its drawer slides are accommodated by these surfaces which are normal to the direction of movement of the drawer. This means that there is no twisting on the connecting clips which would otherwise tend to cause them to become disengaged. This is a major advantage of the clips of the present invention over the first mentioned prior art clip described above.

It will, of course, be appreciated that the stop 11 on each construction of clip is provided to prevent the spring-loaded part 13 or the arm 14 being moved too far when release pressure is applied to the release latch portion 15.

Figure 9:
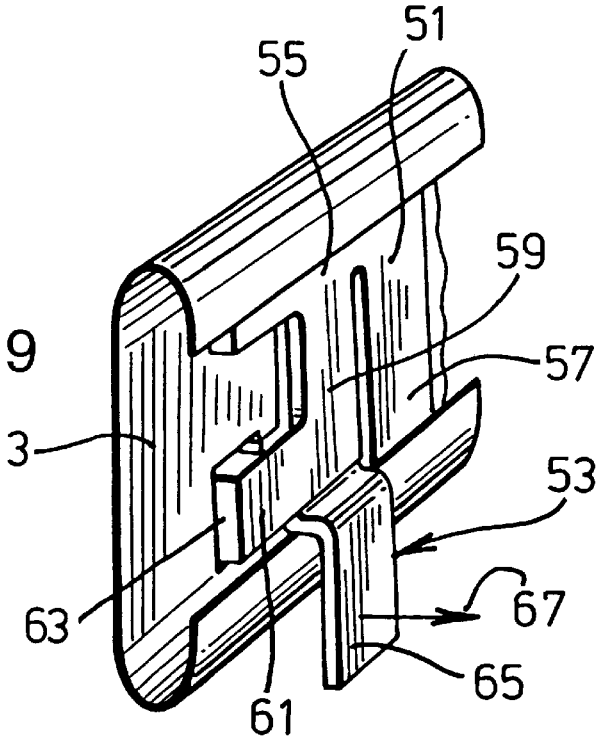
FIG. 9 is a perspective view of a front of a drawer slide showing an alternative embodiment of a two-piece clip mounted thereon.

Although the clips of the present invention are preferably moulded from plastics material, they could be formed of a springy metal and have alternative constructions. One such alternative construction is shown in FIG. 9; this is a two-part construction comprising a first retaining part 51 and a second release part 53. In this construction, the retaining part 51 has upper and lower edge regions 55, 57, the free end portions of which engage behind the turned-over edge regions of the slide member 3. The first retaining part 51 has an extension arm 59 on an outer kinked end portion 61 of which is located a projection 63, equivalent to the projection 17. The second releasing part 53 is somewhat similar in construction to the spring-loaded part 13 or arm 14 and is located behind the extension arm 59 and provided with a release-latch portion 65, equivalent to the portion 15. As will be apparent from FIG. 9, by applying pressure to the release latch portion 65 in the direction of the arrow 67, pressure will be applied to the kinked end portion 61, so as to move the projection 63 in the direction of the arrow 67, thus allowing the projection 63, which is designed for engagement within an aperture in the side wall of the drawer, to be moved to a release position. It will, of course, be appreciated that the two-piece construction as shown in FIG. 1 could be manufactured in one piece. This construction could be manufactured from plastics material, or from spring metal, or a mixture of the two.

Figure 10:
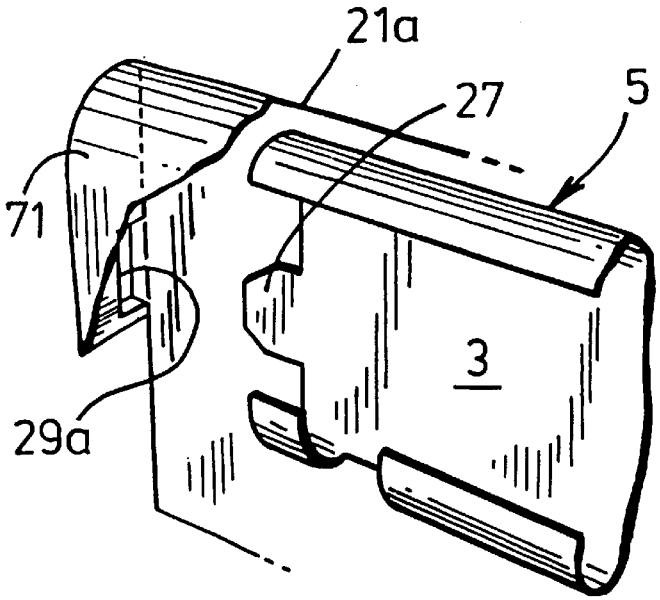
FIG. 10 is a perspective view showing how the nose on the front of a slide engages with an aperture in the front of a shrouded drawer.

Furthermore, this construction could be made in one part by forming the releasing part 53 integral with the parts 57 and 59. In FIG. 10, a modified shrouded drawer 21*a* is shown, and thus differs from that of the other Figures in that it has a drawer shroud largely overlying the slide 5, which is connected to the side wall of the drawer by a front wall. This has an aperture 29*a* therein, within which the nose 27*a* on the slide member 3 engages.

It will, of course, be understood that the present invention has been described above purely by way of example, and modifications of detail can be made within the scope of the invention.

For example, it is not essential for the latching part 12 or arm 14 to be spring loaded. Instead, the latching part or arm could be constructed so as to engage with the aperture in the side wall of the drawer with an interference fit, so that it would effectively have to be snapped into latching engagement with, and out of latching engagement with the aperture. Furthermore, in the drawings, the latching part 12 (and arm 14) are shown of a construction which pivots into and out of latching engagement with the aperture in the side of the drawer. In a modified construction, movement into and out of engagement with the aperture could be achieved in a sliding manner.

What is claimed is:

1. A drawer slide and drawer combination incorporating a quick-release connection between the drawer slide and drawer, the combination comprising the drawer, the drawer slide including at least two slide members slidable relative to one another, an external one of said members being connectable to a framework and an inner one of said members being connectable to the drawer, and a clip having a fixing part connecting the clip to one of the inner slide member and the drawer, and a latching part having a projection thereon engaging an aperture or recess in the other of the inner slide member and the drawer, the projection and the aperture or recess having cooperating surfaces providing both vertical and fore-and-aft latching, the latching part being moveable between a first position in which the projection engages with the aperture or recess to connect the drawer to the inner slide member and a second position in which it is disengaged from the aperture or recess to disconnect of the drawer from the inner slide member, there being means on or able to act on the latching part to enable the part to be moved between its first and second positions.

2. The combination according to claim 1, in which the clip is formed of two separate parts, one comprising the fixing part and the other comprising the latching part.

3. The combination according to claim 1 wherein the latching part of the clip is spring loaded.

4. The combination according to claim 1, wherein the clip is a single moulded part with the latching part being provided with a spring bias by moulding the latching part in a material which is resiliently deformable with a set, whereby when relaxed, it will take up its first position.

5. The combination according to claim 1 wherein the clip comprises a stop which prevents the latching part being moved through more than a few degrees when it is moved to its second position.

6. The combination according to claim 1 wherein the projection comprises two chamfered surfaces arranged at right angles to one another.

7. The combination as claimed in claim 1 wherein the clip is of molded construction.

8. The combination as claimed in claim 1 wherein the clip comprises a resilient plastics material.

9. A combination according to claim 1, wherein a cooperating means on the drawer and drawer slide comprises a projecting nose at the front end of the slide which engages within a recess in the front of the drawer.

10. The drawer slide and drawer combination of claim 1 comprising cooperating means on the drawer and drawer slide holding the side of the drawer closely adjacent to the side of the slide.

11. A drawer slide and drawer combination incorporating a quick-release connection between the drawer slide and drawer, the combination comprising the drawer, the drawer slide comprising at least two slide members slidable relative to one another, an external one of said members being connectable to a framework and an inner one of said members being connectable to the drawer and a clip having a fixing part connecting the clip to one of the inner slide member and the drawer, and a spring-loaded latching part having a projection thereon engaging an aperture or recess in the other of the inner slide member and the drawer, the projection and the aperture or recess having cooperating surfaces providing both vertical and fore-and-aft latching, the latching part being moveable between a first position in which the projection engages with the aperture or recess to connect the drawer to the inner slide member and a second position in which it is disengaged from the aperture or recess to disconnect of the drawer from the inner slide member, there being means on or able to act on the latching part to enable the part to be moved between its first and second positions, wherein co-operating means are provided on each part of the clip to assist in holding them together in use, with the spring loaded latching part comprising a leaf spring portion on the fixing part, and the spring loaded portion being held in position, in use, by being sandwiched between the fixing part and the one of the inner slide member and the drawer to which the fixing part may be connected.

12. A drawer slide and drawer combination incorporating a quick-release connection between the drawer slide and drawer, the combination comprising the drawer, the drawer slide comprising at least two slide members slidable relative to one another, an external one of said members being connectable to a framework and an inner one of said members being connectable to the drawer and a clip having a fixing part connecting the clip to one of the inner slide member and the drawer, and a latching part having a projection thereon engaging an aperture or recess in the other of the inner slide member and the drawer, the projection and the aperture or recess having cooperating surfaces providing both vertical and fore-and-aft latching, the latching part being moveable between a first position in which the projection engages with the aperture or recess to connect the drawer to the inner slide member and a second position in which it is disengaged from the aperture or recess to disconnect of the drawer from the inner slide member, there being means on or able to act on the latching part to enable the part to be moved between its first and second positions and a stop on the clip which prevents the latching part from being moved through more than a few degrees when it is moved to its second position.

13. A drawer slide and drawer combination incorporating a quick-release connection between the drawer slide and drawer, the combination comprising the drawer, the drawer slide comprising at least two slide members slidable relative to one another, an external one of said members being connectable to a framework and an inner one of said members being connectable to the drawer and a clip having a fixing part connecting the clip to one of the inner slide member and the drawer, and a latching part having a projection thereon having two chamfered surfaces arranged at right angles to one another and engaging an aperture or recess in the other of the inner slide member and the drawer, the projection and the aperture or recess having cooperating surfaces providing both vertical and fore-and-aft latching, the latching part being moveable between a first position in which the projection engages with the aperture or recess to connect the drawer to the inner slide member and a second position in which it is disengaged from the aperture or recess to disconnect of the drawer from the inner slide member, there being means on or able to act on the latching part to enable the part to be moved between its first and second positions.

* * * * *

UNITED STATES PATENT AND TRADEMARK OFFICE

CERTIFICATE OF CORRECTION

PATENT NO. : 6,199,967 B1
DATED : March 13, 2001
INVENTOR(S) : Bayles et al.

It is certified that error appears in the above-identified patent and that said Letters Patent is hereby corrected as shown below:

Title page,
Item [30] Foreign Application Priority Data
July 7, 1998 (GB).....9814730.9

Signed and Sealed this

Sixth Day of November, 2001

*Attest:*

Nicholas P. Godici

*Attesting Officer*

NICHOLAS P. GODICI
*Acting Director of the United States Patent and Trademark Office*